US010190784B1

(12) United States Patent
Rue

(10) Patent No.: US 10,190,784 B1
(45) Date of Patent: Jan. 29, 2019

(54) FLEXIBLE DUCT SYSTEM

(71) Applicants: Richard L Rue, McKinney, TX (US); Dean M. Villanueva, McKinney, TX (US)

(72) Inventor: Richard L Rue, McKinney, TX (US)

(73) Assignees: Richard L. Rue, Dallas, TX (US); Dean M. Villanueva, Dallas, TX (US)

( * ) Notice: Subject to any disclaimer, the term of this patent is extended or adjusted under 35 U.S.C. 154(b) by 489 days.

(21) Appl. No.: 14/827,211

(22) Filed: Aug. 14, 2015

(51) Int. Cl.
*F24F 3/044* (2006.01)
*F24F 13/02* (2006.01)

(52) U.S. Cl.
CPC ..... *F24F 3/044* (2013.01); *F24F 13/0209* (2013.01); *F24F 13/0218* (2013.01); *F24F 13/0254* (2013.01); *F24F 2003/0448* (2013.01)

(58) Field of Classification Search
CPC .... F24F 3/044; F24F 13/0209; F24F 13/0218; F24F 13/0254; F24F 2003/0448
USPC ..... 454/232, 306, 370, 903
See application file for complete search history.

(56) References Cited

U.S. PATENT DOCUMENTS 3,354,947 A * 11/1967 McKinnon ..... F24D 5/02 165/103
4,023,472 A * 5/1977 Grunder ..... F24F 7/10 454/338
4,633,768 A * 1/1987 Benson ..... F24F 7/10 237/46
4,902,315 A * 2/1990 Spicer ..... B01D 46/42 454/238
4,955,997 A * 9/1990 Robertson, III ..... F24F 3/1603 454/230

(Continued)

*Primary Examiner* — Gregory Huson
*Assistant Examiner* — Dana Tighe
(74) *Attorney, Agent, or Firm* — Mark W Handley

(57) ABSTRACT

A flexible duct system has fittings connecting sections of the flexible duct which are pulled taut between adjacent ones of the fittings. A first fitting has a first end and a second end. The second end is distally disposed from the first end and defines a second terminal end and having a second end profile. A second fitting has a forward end and a rearward end. The forward end preferably faces toward the first fitting, spaced apart from the second end of the first fitting. The forward end defines a third terminal end and a third end profile. The rearward end is distally disposed from the forward end, and defines a fourth terminal end and a fourth end profile. The end profiles preferably each include a tapered surface and a catch shoulder. The tapered surfaces circumferentially extend around a central axis of a respective end profile and face in directions which extend outward of the respective end profile with the tapered surfaces narrowing in the respective outwardly extending direction. The catch shoulders face in respective directions opposed to the outwardly extending directions and are spaced apart from respective outward terminal ends of the respective end profile to define abutments. The fittings are formed to provide Tee fittings, reducer fittings, and end caps, and include support members for securing the fittings in fixed positions. Some fittings have ends with spaced apart multiple end profiles of progressively reduced sizes with cut lines disposed between the multiple end profiles.

21 Claims, 7 Drawing Sheets

(56) References Cited

U.S. PATENT DOCUMENTS

| | | | | | |
|---|---|---|---|---|---|
| 5,095,942 | A * | 3/1992 | Murphy | F16L 9/003 | 137/561 A |
| 5,151,063 | A * | 9/1992 | Tanaka | F24F 7/06 | 454/258 |
| 5,207,615 | A * | 5/1993 | Edmisten | F24F 13/0236 | 251/297 |
| 6,231,704 | B1 * | 5/2001 | Carpinetti | F16L 9/003 | 138/149 |
| 2006/0199505 | A1 * | 9/2006 | Fettkether | F24F 13/0218 | 454/232 |
| 2009/0266903 | A1 * | 10/2009 | Fitzgerald | F24F 13/105 | 236/49.3 |

* cited by examiner

FLEXIBLE DUCT SYSTEM

TECHNICAL FIELD OF THE INVENTION

The present invention relates in general to duct work for building air handling systems, and in particular to flexible ducting for building air conditioning systems.

BACKGROUND OF THE INVENTION

Air conditioning systems are conventionally provided within buildings using either sheet metal ducting or flexible duct systems. Sheet metal ducting provides rigid metal ducts which may be laid-out and installed in tidy configurations and which are not easily subject to movement. However, sheet metal ducting is typically more expensive and time consuming for installation, requiring more detailed engineering and labor to specify sizes and lengths for ducts, providing inventory of ducts of particular sizes, cutting ducts to particular length during installation, and to install rigid sections of metal duct. On the other hand, flexible duct systems are much less engineering and labor intensive, with the flexible ducting readily adaptable into various installations. Flexible duct is readily cut to length during installation and each section does not have to be specifically manufactured for a particular size as does formed metal ducting. However, flexible metal duct is not tidy when installed. Since flexible duct is not rigid, it sags or droops between end connections and is typically laid in a crawl space or attic, directly on the floor of such spaces. Connections of multiple flex duct to a primary plenum typically appear much more like a spaghetti jumble rather than the clean configuration of rigid metal ducting after installation.

SUMMARY OF THE INVENTION

A flexible duct system providing tidy installations is disclosed for connecting between an air handling unit and one or more building spaces for passing building air between the air handling unit and the one or more building spaces. A first fitting is connected to the air handling unit. The first fitting has a first fitting longitudinal axis, a first end, and a second end. The first end faces in a first direction and is connected to the air handling unit. The second end is distally disposed from the second end defining a second terminal end and having a second end profile. A second fitting has a central longitudinal axis, a forward end, and a rearward end. The forward end preferably faces in a first direction toward the first fitting, spaced apart from the second end of the first fitting. The forward end defines a third terminal end and a third end profile. The rearward end is distally disposed from the forward end and defines a fourth terminal end and a fourth end profile. The end profiles preferably each include a tapered surface and a catch shoulder. The tapered surfaces circumferentially extend around a central axis of the respective end profile in which it is included, face in respective directions which extend outward of the respective end profile with the tapered surface narrowing in the outwardly extending respective direction. The catch shoulders face in directions opposed to the respective outwardly extending direction and are spaced apart from an outward terminal end of the respective end profile to define abutments.

The fittings are formed to provide Tee fittings for connecting branch ducts, reducer fittings, and end caps. The fittings have support members which exteriorly extend from an intermediate portion of the fittings to mounting bars for fixedly securing the fittings in fixed relation to the building.

In some embodiments of the present disclosure, at least one of the ends of the first and second fitting have multiple end profiles, each of the multiple end profiles disposed in alignment for tapering in an outward direction for being received in respectively smaller nominal sizes of flex ducting. The multiple end profiles are spaced apart with cut-lines disposed between adjacent ones of the multiple ends. The fittings are preferably formed of thermoplastic materials. At least one of the fittings has a rearward end which is formed to provide an end cap for sealing the end of a duct.

A first flexible duct has a first end portion and a second end portion which are distally spaced apart. The first end portion fits over the second end profile of the first fitting and the second end portion fits over the third end profile of the third fitting. A first band extends around the first end portion and engages the second end profile to fixedly secure the first end portion of said first flexible duct to the first fitting. A second band extends the second end portion of the first flexible duct and engages against the third end profile to fixedly secure the second end portion to the forward end of the second fitting. A first flexible duct section is preferably pulled taut between said first fitting and the second fitting, and held in place by said first and second bands engaging respective ones of the second and third end profiles. Additional fittings are added to secure additional flexible duct sections between adjacent fittings, preferably with the additional flexible duct sections pulled taut.

DESCRIPTION OF THE DRAWINGS

For a more complete understanding of the present invention and the advantages thereof, reference is now made to the following description taken in conjunction with the accompanying Drawings in which

FIG. 1 is a top plan view of a conventional ducting for a building air conditioning system;

FIG. 2 is an exploded view of a trunk section formed of flexible ducting;

FIG. 3 is perspective view of the square to round adapter fitting;

FIG. 4 is a perspective view of a tee fitting for coupling with flexible duct providing branch sections and trunk sections;

FIG. 5 is a perspective view of the reducer fitting;

FIG. 6 is a perspective view of the end cap fitting;

FIG. 7 is a perspective view showing first steps in securing respective ends of the flexible duct sections to terminal ends of connector fittings;

FIG. 8 is a perspective view showing final steps in securing respective ends of the flexible duct sections to terminal ends of connector fittings;

FIG. 9 is a perspective view of the square to round adapter fitting having removable reducer sections;

FIG. 10 is perspective view of a tee fitting for coupling with flexible duct providing branch sections and trunk sections; and FIG. 11 is a perspective view of a reducer end cap fitting having removable sections and an end cap section.

DETAILED DESCRIPTION OF THE INVENTION

Figure 1:
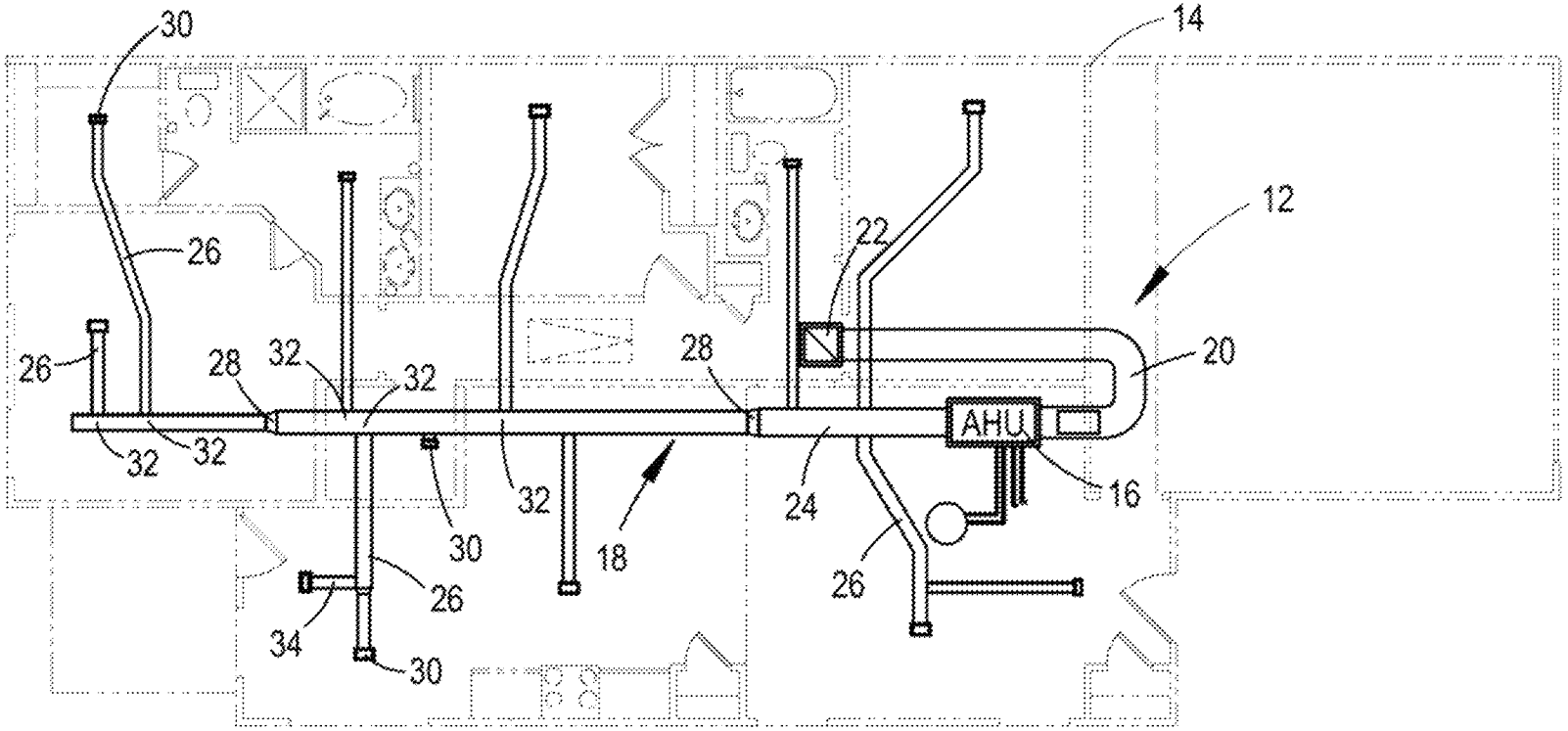
FIGS. 1 through 11 show various aspects for flexible duct system devices made according to the present invention, as set forth below.

FIG. 1 is a top plan view of a conventional ducting for an AC system 12 used in a building 14. The AC system 12 has an air handling unit 16 to which are connected supply duct 18 and return duct 20. The return duct 20 connects between the intake of the air handling unit 16 and a return plenum 22. The supply duct 18 has a trunk section 24 and branch sections 26 which connect to and extend outward from the trunk section 24. Reducer fittings 28 are provided within the trunk section 24 to reduce the cross sectional area of the trunk section 18 as air is removed and passed through the branch sections 26. Supply vents 30 are provided for connecting between the supply duct 18 and in the spaces to be conditioned within the building 14. Tee's 32 are fittings which connect between the branch sections 26 and the trunk section 24. There may also be additional branch sections such as the section 34 which extends off of one of the branch sections 26.

Figure 2:
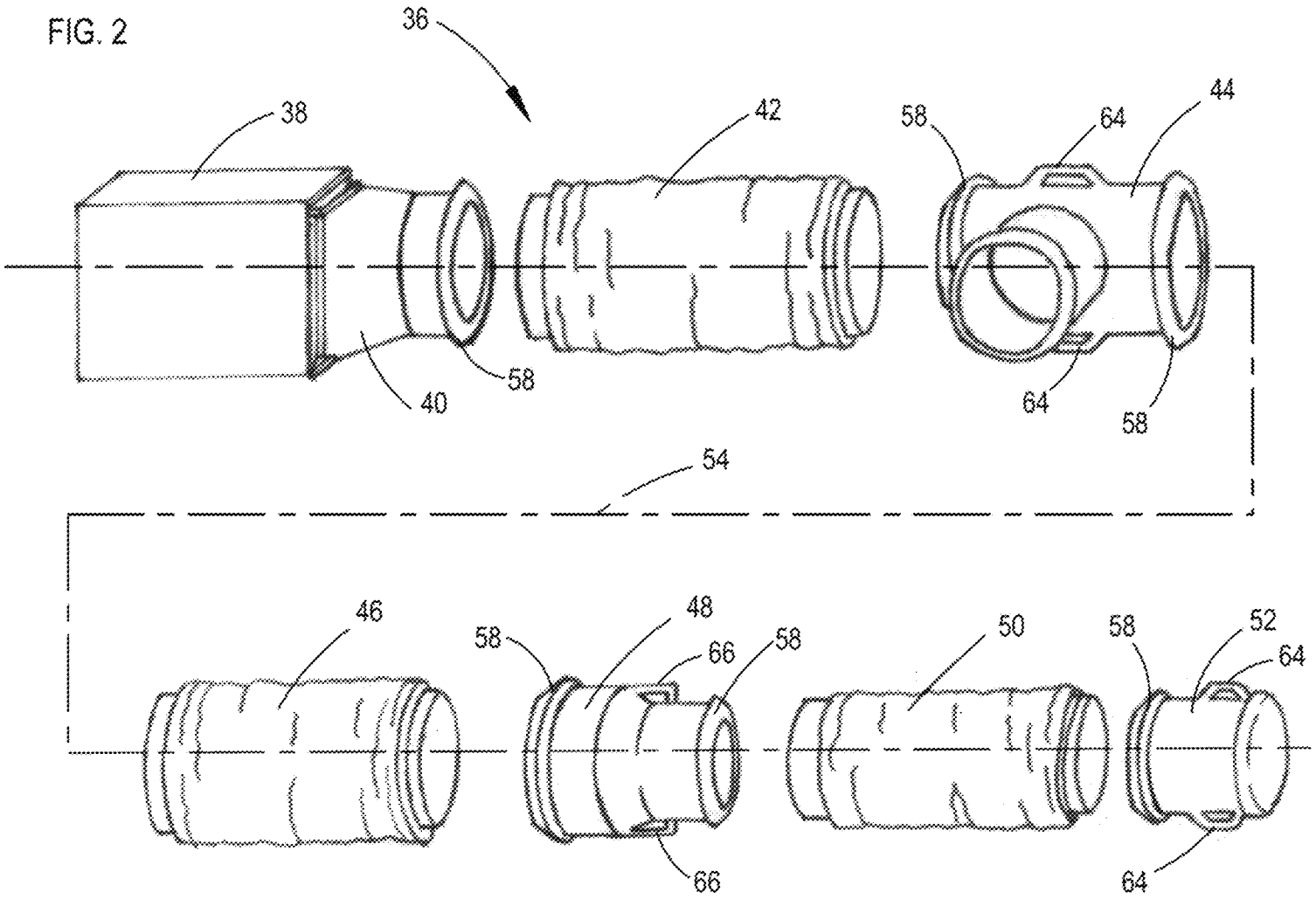

FIG. 2 is an exploded view of a trunk section 24 formed of flexible duct 36 according to the present invention. A supply plenum 38 extends off the air handling unit 16 and is shown having a square cross-section. A transition fitting 40 is provided for connecting to the supply plenum 38. An outward end or downstream end of the transition fitting 40 is provided with a terminal end profile 58 for coupling with a duct section 42. The duct section 42 is preferably provided by flexible duct. The downstream end of the duct section 42 connects to a first terminal end profile 58 of a tee 44. The tee 44 provides a fitting for connecting to two branch sections 26. A second end of the tee 44 has a second end profile 58 which is adapted for connecting to a duct section 46. The duct section 46 is also preferably a flexible type of duct, and a downstream end of the duct section 46 connects to a end profile 58 of a reducer fitting 48. The reducer fitting 48 has a second end profile 58 which is adapted for connecting to a duct section 50. The duct section 50 is preferably a flexible duct. A second end of the flexible duct 50 is connected to a first end of an end cap fitting 52. The end cap fitting 52 also has a end profile 58 which attaches for securing the duct section 50 thereto. The trunk section 24 has a centrally disposed, longitudinal axis 54 about which the flexible duct 36 and the fittings 40, 44, 48 and 52 are preferably coaxially disposed.

Figure 3:
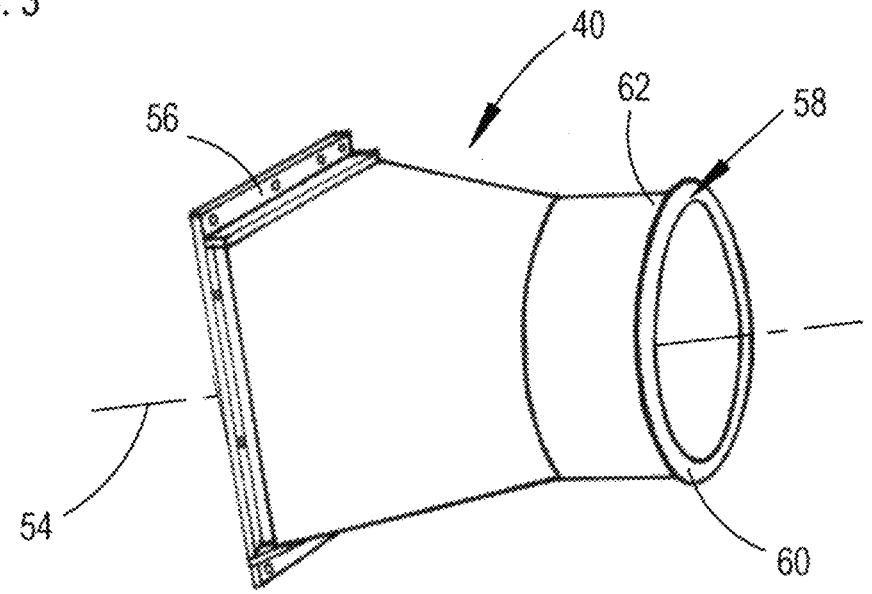

FIG. 3 is a perspective view of the transition fitting 40 providing square to round adapter fitting. A first end of the transition fitting 40 has a flange 56 for securing to the supply plenum 38. A second end, which is a downstream end of the transition fitting 40, has the end profile 58. The end profile 58 has a tapered surface 60 which provides a guide surface which is beveled for guiding a terminal end of the duct section 42 over the end profile 58 of the square to round adapter fitting 40. Spaced apart from the terminal end, from the outermost end or downstream most end of the transition fitting 40 is a catch shoulder 62, which is preferably annular shaped and inward facing relative to the end profile 58. The catch shoulder 62 provides an abutment for placing securing straps 92, 94 and 96 around the terminal ends of the duct sections 42, 46 and 50 for securing the terminal ends of the duct sections 42, 46 and 50 to respective ones of the fittings 40, 44, 48 and 52.

Figure 4:
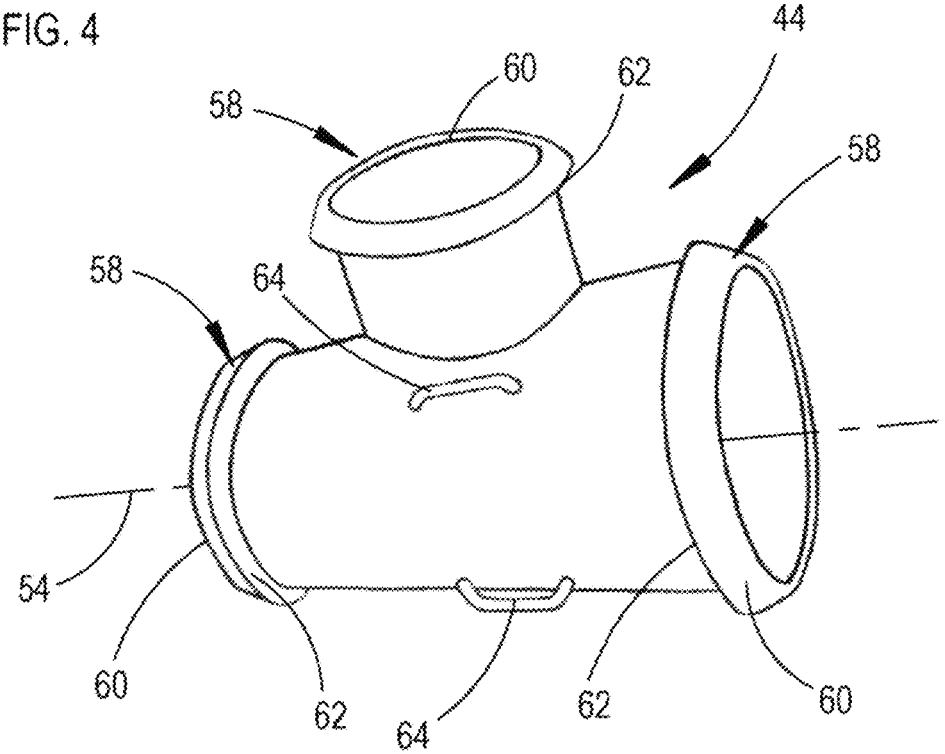

FIG. 4 is a perspective view of the tee 44 for coupling to flexible duct providing branch sections and trunk sections. The tee 44 has two end profiles 58, each with tapered surfaces 60 and catch shoulder 62. The tee 44 additionally has mounting members 64 which provides loops that define stabilizing bars for securing tie down straps thereto for rigidly affixing the tee 44 in a fixed position relative to the building 14 and the air handling unit 16.

Figure 5:
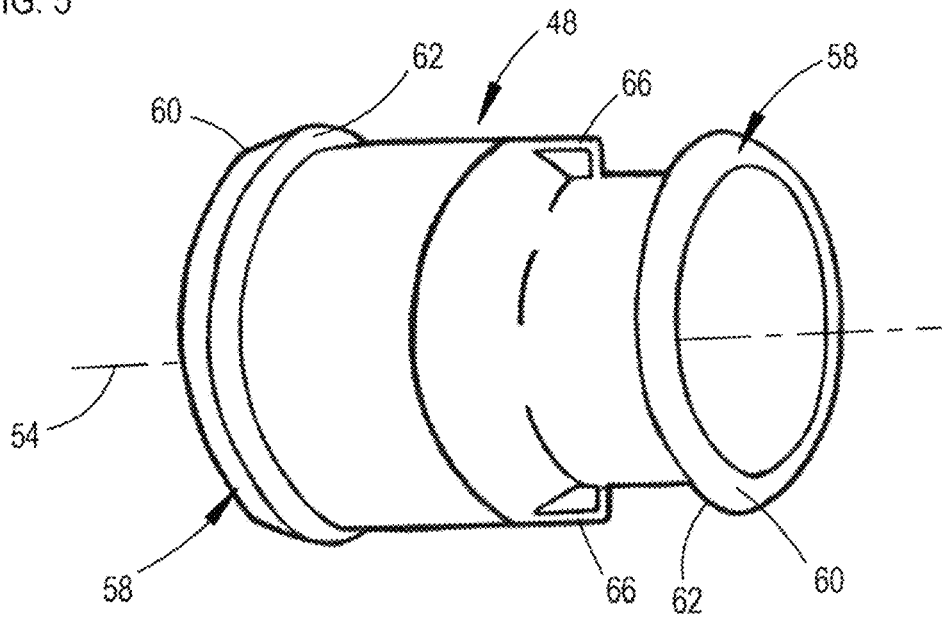

FIG. 5 is a perspective view of the reducer fitting 48. The reducer fitting 48 has opposite fitting end profiles 58 for securing respective ones of the ducts 46 and 50 thereto. The reducer fitting 48 further includes mounting members 66 which provide loops which define stabilizing bars for receiving respective ones of the securing straps 92, 94 and 96.

Figure 6:
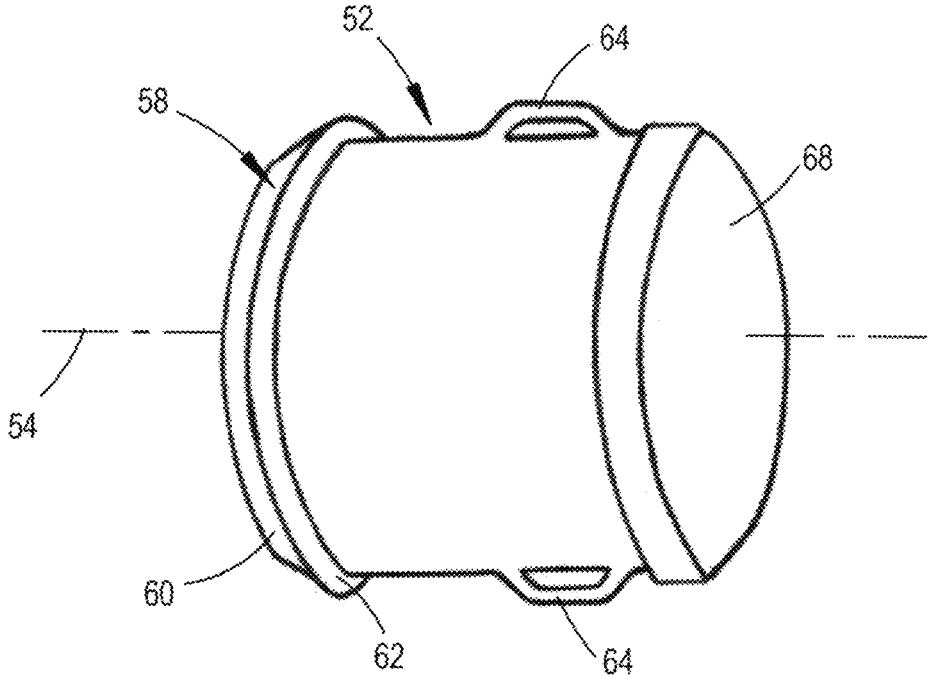

FIG. 6 is a perspective view of the end cap fitting 52. The end cap fitting 52 preferably has a first end which provides a fitting end profile 58 with a tapered surface 60 and a catch shoulder 62. The second end of the end cap fitting 52 preferably includes an end cap 68. The end cap 68 seals the terminal end of the flexible duct section 36. The end cap fitting 52 further includes mounting members 64 which provide loops which define stabilizing bars for receiving the securing straps 92, 94 and 96.

Figure 7:
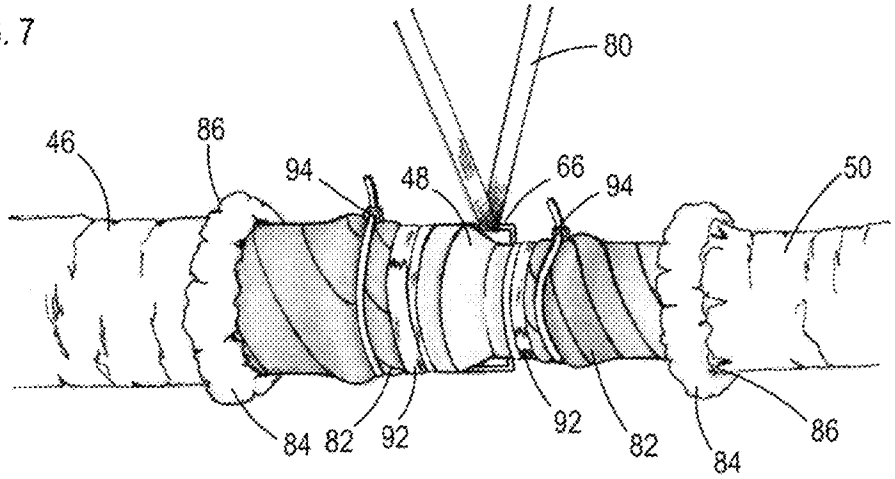
Figure 8:
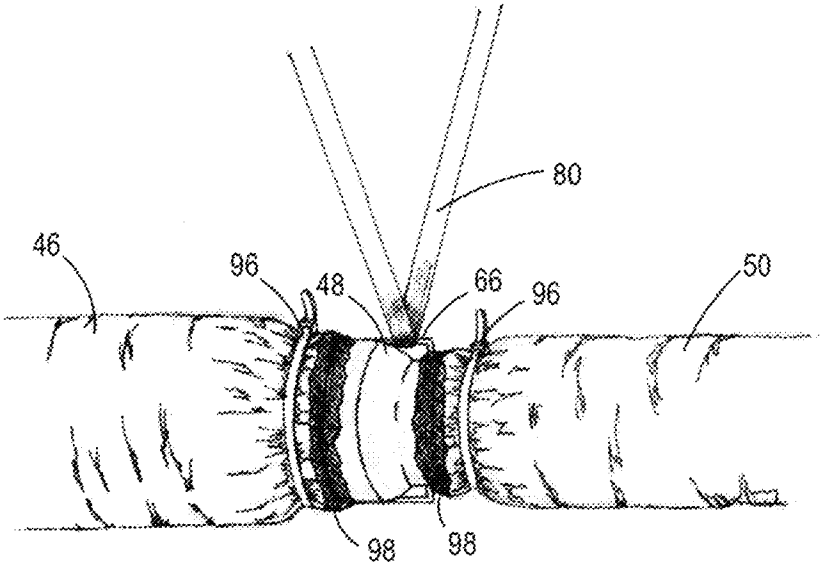

FIGS. 7 and 8 are perspective views showing the steps in securing respective ends of the flexible duct sections 42, 46 and 50 to the fittings 40, 44, 48 and 52. Only the reducer fitting 48 is shown, but the other fittings 40, 44 and 52 will be secured by the same method. First and inner layer 82 as shown in FIG. 7, is secured over the end profiles 58, with the tapered guide surface 60 and the catch shoulder 62 fitting within the terminal end of the ducts 46 and 50. Tape is then wrapped around the terminal end portion of the ducts 46 and 50 and an inner tie band 94, preferably a self locking plastic tie, is secured about the inner layer 42, adjacent to the catch shoulder 62, as shown in FIG. 8. Then the outer layer of insulation 84 which is preferably fiber glass and the outer covering or jacket 86 is extended over the fitting terminal end 58, beyond the catch shoulder 62, and an outer tie band 96 is secured thereto adjacent the inward side of the catch shoulder 62. Mastic 98 is then applied to seal closed the inner layer, the insulation, and the outer jacket 86. The mounting straps 80 may be seen secured to the mounting member 66 to suspend the reducer fitting 48 in a fixed position.

Figure 9:
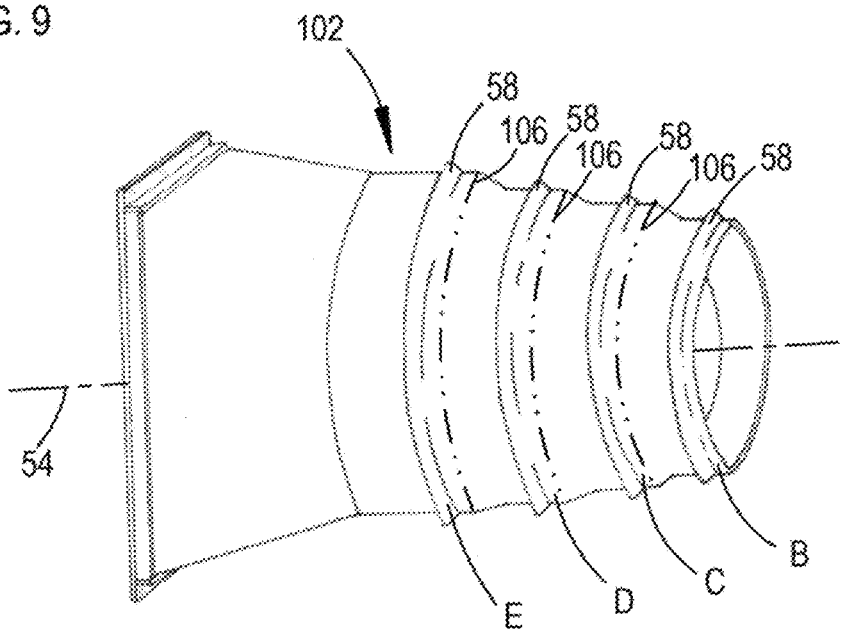

FIG. 9 is perspective view of a transition fitting 102 providing a square to round adapter fitting having multiple end profiles 58. The transition fitting 102 has an open terminal downstream end 108 and an open upstream end 110. A flange 112 is provided for securing to the supply plenum 38 (shown in FIG. 2). The multiple end profiles 58 are spaced apart and are of increasingly smaller sizes in moving toward terminal ends of the transition fitting 102, defining a plurality of reducer sections 104. Cut lines 106 are provided between each of the adjacent end profiles 58. The cut lines 106 are preferably molded into the transition fitting 102, preferably scored to identify where to cut. In some embodiments, the cut lines 106 may be provided by perforations. The fitting 102 is preferably molded of thermoplastic such that is may be easily cut along scored cut lines 106 during installation. Each of the end profiles 58 have a tapered surface 60 which faces outward of the fitting 102 and provides a guide surface which is beveled for guiding a terminal end of the duct section 42 over the end profile 58. Spaced apart from the smaller terminal ends of each of the tapered shoulders 60 is a catch shoulder 62, which is preferably annular shaped and inward facing relative to the tapered surface 60 of the respective end profile 58. The catch shoulders 62 provide abutments for retaining securing straps, such as the straps 92, 94 and 96 which are placed around the terminal ends of duct sections to secure flex ducting thereto.

Figure 10:
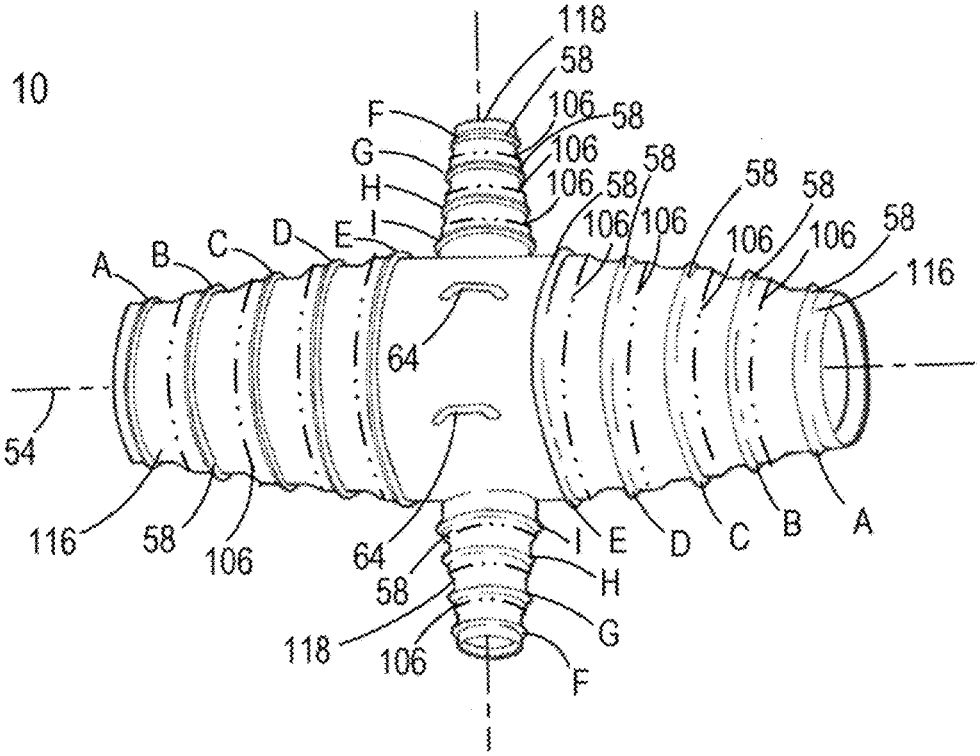

FIG. 10 is perspective view of a tee fitting 114 having trunk connections 116 and branch connections 118 for coupling with flexible duct providing branch sections and trunk sections. Each of the trunk connections 116 and the branch connections 118 of the tee 114 preferably has multiple end profiles 58 which are spaced apart and are of increasingly smaller sizes in moving toward terminal ends of respective ones of the branch and trunk connections 116, 118 which define a plurality of reducer sections 104. Cut lines 106 are provided between each of the adjacent end profiles 58. The cut lines 106 are preferably molded into the transition fitting 102, preferably scored to identify where to cut. In some embodiments, the cut lines 106 may be provided by perforations. The Tee fitting 114 is preferably molded of thermoplastic such that is may be easily cut along scored cut lines 106 during installation. Each of the end profiles 58 have a tapered surface 60 which faces outward of the fitting 102 and provide a guide surface which is beveled for guiding a terminal end of the duct section 42 over the end profile 58. Spaced apart from the smaller terminal ends of each of the tapered shoulders 60 is a catch shoulder 62, which is preferably annular shaped and inward facing relative to the tapered surface 60 of the respective end profile 58. The catch shoulders 62 provide abutments for retaining securing straps, such as the straps 92, 94 and 96 which are placed around the terminal ends of duct sections to secure flex ducting thereto. The tee 44 additionally has mounting members 64 which provides loops that define stabilizing bars for securing tie down straps thereto for rigidly securing the tee 44 in a fixed position relative to the building 14.

Figure 11:
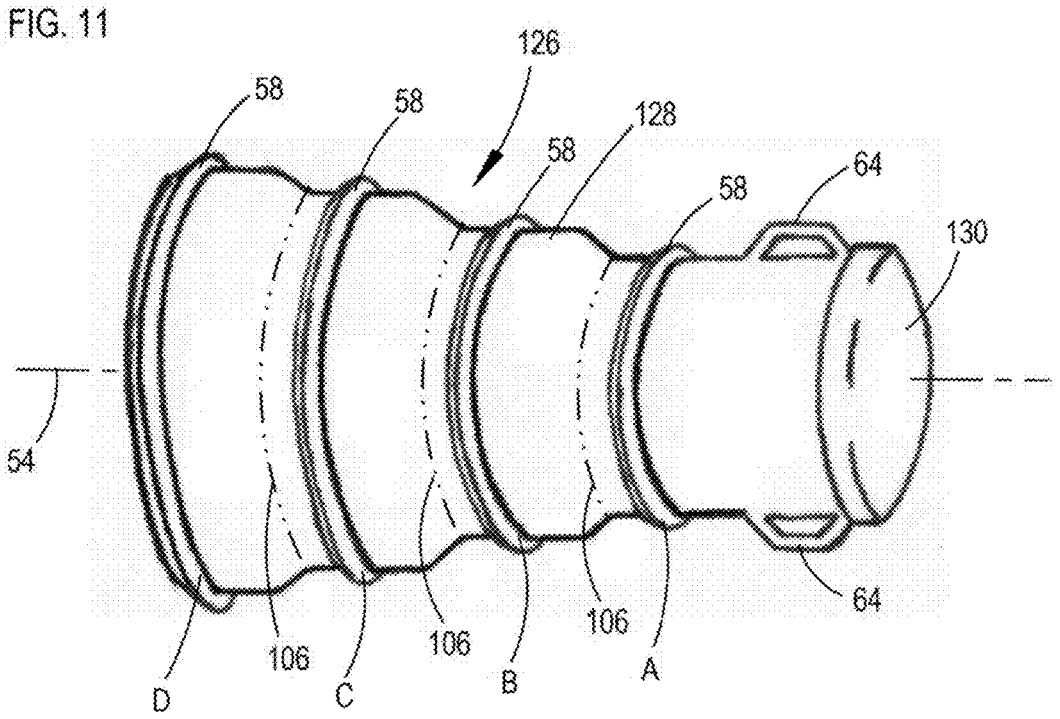

FIG. 11 is a perspective view of a reducer end cap fitting 126 which defines a reducer end section 128 having an integral end cap 130. The reducer end section 128 has multiple end profiles 58 which are spaced apart and are of increasingly smaller sizes in moving toward the end cap 120. In other embodiments, the reducer section 128 may taper in an opposite direction, such that the end cap end is larger. A plurality of reducer sections 104 are defined and cut lines 106 are provided between each of the adjacent end profiles 58. The cut lines 106 are preferably molded into the transition fitting 102, preferably scored to identify where to cut. In some embodiments, the cut lines 106 may be provided by perforations. The end cap fitting 126 is preferably molded of thermoplastic such that is may be easily cut along scored cut lines 106 during installation. Each of the end profiles 58 have a tapered surface 60 which faces outward of the fitting 102 and provide a guide surface which is beveled for guiding a terminal end of the duct section 42 over the end profile 58. Spaced apart from the smaller terminal ends of each of the tapered shoulders 60 is a catch shoulder 62, which is preferably annular shaped and inward facing relative to the tapered surface 60 of the respective end profile 58. The catch shoulders 62 provide abutments for retaining securing straps, such as the straps 92, 94 and 96 which are placed around the terminal ends of duct sections to secure flex ducting thereto. The reducer end cap 126 also has mounting members 64 which provides loops that define stabilizing bars for securing tie down straps thereto for rigidly securing the tee 44 in a fixed position relative to the building 14.

The fittings 102, 114 and 126 are preferably cut to fit various nominal duct sizes. The following Table A shows typical nominal sizes for the reference letters listed in FIGS. 9-11:

TABLE A

| Section | Large Fitting Set | Small Fitting Set |
|---|---|---|
| A | 18" | 8" |
| B | 20" | 10" |
| C | 22" | 12" |
| D | 24" | 14" |
| E | — | 16" |
| F | 6" | 6" |
| G | 7" | 7" |

TABLE A-continued

| Section | Large Fitting Set | Small Fitting Set |
|---|---|---|
| H | 8" | 8" |
| I | 9" | 9" |

The present invention provides advantages of flexible duct installations with sections of flexible duct pulled taut between adjacent fittings. This provides for the ease and simplicity of installation of a flexible ducting system with the clean, tidy appearance of rigid ducting systems. End profiles are provided for the fittings to allow end portions of flexible duct sections to be fixedly secured to the fittings, with at least some of the fittings having mounting members for securing the fittings in fixed positions within buildings. The end profiles are preferably tapered and include abutments provided by shoulders spaced apart from terminal ends of the fittings for securing the flexible duct end portions with bands. Various fittings may have multiple end profiles spaced apart in adjacent relation with cut lines there-between to allow one fitting to be used for multiple flex duct sizes, reducing inventory requirements for duct installation businesses.

Although the preferred embodiment has been described in detail, it should be understood that various changes, substitutions and alterations can be made therein without departing from the spirit and scope of the invention as defined by the appended claims.

What is claimed is:

1. A flexible duct system for connecting between an air handling unit and one or more building spaces for passing building air between the air handling unit and the one or more building spaces, the flexible duct system comprising:

a first fitting connected to the air handling unit, said first fitting having a first fitting longitudinal axis, a first end facing in a first direction and connected to the air handling unit for passing an air flow there-between, and a second end which is distally disposed from the air handling unit, said second end defining a second terminal end and having a second end profile;

a first flexible duct having a first end portion fitting over said second end profile of said first fitting, and said first flexible duct further having a second end portion which is distally disposed from said first end portion;

a first band extending around said first end portion of said first flexible duct and engaging against said second end profile to fixedly secure said first end portion of said first flexible duct to said first fitting;

a second fitting which is spaced apart from said first fitting, said second fitting having a second fitting longitudinal axis and a forward end which defines a third terminal end, said forward end having a third end profile;

said second portion of said first flexible duct section fitting over said third end profile of said second fitting;

a second band extending around said second end portion of said first flexible duct and engaging against said third end profile to fixedly secure said second end portion of said first flexible duct to said forward end of said second fitting; and wherein said first flexible duct is pulled taut between said first fitting and said second fitting, and held in place by said first and second bands engaging respective ones of said second end profile and said third end profile.

2. The flexible duct system according to claim 1, wherein said second end profile comprises: a tapered surface and a catch shoulder, wherein said tapered surface circumferentially extends around said first fitting longitudinal axis and faces in a second direction which extends outward of said first fitting with said tapered surface narrowing in the second direction, and said catch shoulder faces in a direction opposed to said second direction and is spaced apart from said terminal end to define an abutment; and wherein said third end profile comprises a third tapered surface and a third catch shoulder, wherein said third tapered surface circumferentially extends around said second fitting longitudinal axis and faces in a third direction which extends outward of said second fitting with said third tapered surface narrowing in the third direction, and said third catch shoulder faces in a general direction opposed to said third direction and is spaced apart from said third terminal end to define a third abutment.

3. The flexible duct system according to claim 2, wherein said second fitting has a third fitting rearward end which defines an end cap which seals said third fitting rearward end from airflow there-through.

4. The flexible duct system according to claim 2, wherein said second fitting comprises a T-fitting, such that at least one branch duct extends to pass a portion of an air flow in a direction transverse to an air flow entering said second fitting.

5. The flexible duct system according to claim 2, wherein said first and second fittings are formed of thermoplastic materials.

6. The flexible duct system according to claim 1, wherein said second fitting comprises a reducer fitting, such that at least a respective one of a first cross-sectional area of said third end is larger than a second cross-sectional area of said fourth end.

7. The flexible duct system according to claim 1, further comprising at least one of said first and second fittings having at least one support member which exteriorly extends from an intermediate portion of said second fitting, said support members providing a mount for fixedly securing said second fitting in fixed relation to the building.

8. A flexible duct system for connecting between an air handling unit and one or more building spaces for passing building air between the air handling unit and the one or more building spaces, the flexible duct system comprising:

a first fitting connected to the air handling unit, said first fitting having a first fitting longitudinal axis, a first end facing in a first direction and connected to the air handling unit for passing an air flow there-between, and a second end which is distally disposed from the air handling unit, said second end defining a second terminal end and having a second end profile;

a first flexible duct having a first end portion fitting over said second end profile of said first fitting, and said first flexible duct further having a second end portion which is distally disposed from said first end portion;

a first band extending around said first end portion of said first flexible duct and engaging against said second end profile to fixedly secure said first end portion of said first flexible duct to said first fitting;

a second fitting which is spaced apart from said first fitting, said second fitting having a second fitting longitudinal axis and a forward end which defines a third terminal end, said forward end having a third end profile;

said second portion of said first flexible duct section fitting over said third end profile of said second fitting;

a second band extending around said second end portion of said first flexible duct and engaging against said third end profile to fixedly secure said second end portion of said first flexible duct to said forward end of said second fitting; and said first and second fittings each having at least one support member which exteriorly extends from an intermediate portion of a respective one of said first and second fittings, providing mounts for fixedly securing said first and second fittings in fixed relation to the building, and wherein said support members define support bars which extend in spaced apart relation from exterior surfaces of respective ones of said first and second fittings.

9. A flexible duct system for connecting between an air handling unit and one or more building spaces for passing building air between the air handling unit and the one or more building spaces, the flexible duct system comprising:

a first fitting connected to the air handling unit, said first fitting having a first fitting longitudinal axis, a first end facing in a first direction and connected to the air handling unit for passing an air flow there-between, and a second end which is distally disposed from the air handling unit, said second end defining a second terminal end and having a second end profile;

a first flexible duct having a first end portion fitting over said second end profile of said first fitting, and said first flexible duct further having a second end portion which is distally disposed from said first end portion;

a first band extending around said first end portion of said first flexible duct and engaging against said second end profile to fixedly secure said first end portion of said first flexible duct to said first fitting;

a second fitting which is spaced apart from said first fitting, said second fitting having a second fitting longitudinal axis and a forward end which defines a third terminal end, said forward end having a third end profile;

said second portion of said first flexible duct section fitting over said third end profile of said second fitting;

a second band extending around said second end portion of said first flexible duct and engaging against said third end profile to fixedly secure said second end portion of said first flexible duct to said forward end of said second fitting; and wherein at least one of said ends of said first and second fitting have multiple end profiles, each of said multiple end profiles disposed in alignment for tapering in an outward direction for being received in respectively smaller nominal sizes of flex ducting.

10. The flexible duct system according to claim 9, wherein said multiple end profiles are spaced apart with cut-lines disposed between adjacent ones of said multiple ends.

11. A flexible duct system for connecting between an air handling unit and one or more building spaces for passing building air between the air handling unit and the one or more building spaces, the flexible duct system comprising:

a transition fitting mounted to a plenum connected directly to the air handling unit, said transition fitting providing a square to round transition having a transition fitting longitudinal axis, a first end facing in a first direction and having a square shape which is mounted directly to the plenum, and a second end which is distally disposed from the plenum, said second end defining a second terminal end and which is of a round shape having a second end profile which includes a tapered surface and a catch shoulder, wherein said tapered surface circumferentially extends around said transition fitting longitudinal axis and faces in a second direction which extends outward of said transition fitting with said tapered surface narrowing in the second direction, and said catch shoulder faces in a direction opposed to said second direction and is spaced apart from said second terminal end to define an abutment;

a first flexible duct having a first end portion fitting over said tapered surface and said catch shoulder of said second end of said transition fitting, and said first flexible duct further having a second end portion which is distally disposed from said first end portion;

a first band extending around said first end portion of said first flexible duct and engaging against said catch shoulder to fixedly secure said first end portion of said first flexible duct to said transition fitting;

a second fitting which is spaced apart from said transition fitting, said second fitting having a second fitting longitudinal axis and a forward end which defines a third terminal end, said forward end having a third end profile which includes a third tapered surface and a third catch shoulder, wherein said third tapered surface circumferentially extends around said second fitting longitudinal axis and faces in a third direction which extends outward of said second fitting with said third tapered surface narrowing in the third direction, and said third catch shoulder faces in a general direction opposed to said third direction and is spaced apart from said third terminal end to define a third abutment;

said second portion of said first flexible duct fitting over said third tapered surface and said third catch shoulder of said second fitting; and a second band extending around said second end portion of said first flexible duct and engaging against said third catch shoulder to fixedly secure said second end portion of said first flexible duct to said forward end of said second fitting.

12. The flexible duct system according to claim 11, further comprising:

said second fitting having a rearward end which is spaced apart from said forward end and defines a fourth terminal with a centrally disposed axis, said rearward end having a fourth end profile which includes a fourth tapered surface and a fourth catch shoulder, wherein said fourth tapered surface circumferentially extends around said centrally disposed axis and faces in a fourth direction which extends outward of said second fitting with said fourth tapered surface narrowing in the fourth direction, and said fourth catch shoulder faces in a general direction opposed to said fourth direction and is spaced apart from said fourth terminal end to define a fourth abutment;

a third fitting which is spaced apart from said second fitting, said third fitting having a third fitting longitudinal axis and a third fitting forward end which defines a fifth terminal end, said third fitting forward end having a fifth end profile which includes a fifth tapered surface and a fifth catch shoulder, wherein said fifth tapered surface circumferentially extends around said third fitting longitudinal axis and faces in a fifth direction which extends outward of said third fitting with said fifth tapered surface narrowing in the fifth direction, and said fifth catch shoulder faces in a second general direction opposed to said fifth direction and is spaced apart from said fifth terminal end to define a fifth abutment;

a second flexible duct having a third end portion fitting over said fourth tapered surface and said fourth catch shoulder of said rearward end of said second fitting, and said second flexible duct further having a fourth end portion which is distally disposed from said third end portion;

a third band extending around said first end portion of said second flexible duct and engaging against said catch shoulder to fixedly secure said third end portion of said second flexible duct to said transition fitting;

said fourth end portion of said second flexible duct section fitting over said fifth tapered surface and said fifth catch shoulder of said second fitting; and a fourth band extending around said fourth end portion of said second flexible duct and engaging against said fifth catch shoulder to fixedly secure said fourth end portion of said second flexible duct to said fifth end of said third fitting.

13. The flexible duct system according to claim 12, wherein said third fitting has a third fitting rearward end which defines an end cap which seals said third fitting rearward end from airflow there-through.

14. The flexible duct system according to claim 12, wherein at least one of said second fitting and said third fitting comprises a T-fitting, such that at a least one branch duct extends to pass a portion of an air flow in a direction transverse to an air flow entering said at least one of said second and third fittings.

15. The flexible duct system according to claim 12, wherein said first and second flexible duct sections are pulled taut between respective ones of said transition fitting and said second fitting, and said second fitting and said third fitting.

16. The flexible duct system according to claim 12, wherein said second and third fittings are formed of thermoplastic materials.

17. The flexible duct system according to claim 11, wherein at least one of said second fitting and said third fitting comprises a reducer fitting, such that at least a respective one of a first cross-sectional area of said third end and said fifth is larger than a second cross-sectional area of said fourth end and said sixth end, respectively.

18. The flexible duct system according to claim 11, further comprising said second fitting having at least one support member which exteriorly extends from an intermediate portion of said second fitting, said support members providing a mount for fixedly securing said second fitting in fixed relation to the building.

19. A flexible duct system for connecting between an air handling unit and one or more building spaces for passing building air between the air handling unit and the one or more building spaces, the flexible duct system comprising:

a transition fitting mounted to a plenum connected directly to the air handling unit, said transition fitting having a transition fitting longitudinal axis, a first end facing in a first direction and mounted directly to the plenum, and a second end which is distally disposed from the plenum, said second end defining a second terminal end and having a second end profile which includes a tapered surface and a catch shoulder, wherein said tapered surface circumferentially extends around said transition fitting longitudinal axis and faces in a second direction which extends outward of said transition fitting with said tapered surface narrowing in the second direction, and said catch shoulder faces in a direction opposed to said second direction and is spaced apart from said second terminal end to define an abutment;

a first flexible duct having a first end portion fitting over said tapered surface and said catch shoulder of said second end of said transition fitting, and said first flexible duct further having a second end portion which is distally disposed from said first end portion;

a first band extending around said first end portion of said first flexible duct and engaging against said catch shoulder to fixedly secure said first end portion of said first flexible duct to said transition fitting;

a second fitting which is spaced apart from said transition fitting, said second fitting having a second fitting longitudinal axis and a forward end which defines a third terminal end, said forward end having a third end profile which includes a third tapered surface and a third catch shoulder, wherein said third tapered surface circumferentially extends around said second fitting longitudinal axis and faces in a third direction which extends outward of said second fitting with said third tapered surface narrowing in the third direction, and said third catch shoulder faces in a general direction opposed to said third direction and is spaced apart from said third terminal end to define a third abutment;

said second portion of said first flexible duct fitting over said third tapered surface and said third catch shoulder of said second fitting;

a second band extending around said second end portion of said first flexible duct and engaging against said third catch shoulder to fixedly secure said second end portion of said first flexible duct to said forward end of said second fitting; and said second and third fittings each having at least one support member which exteriorly extends from an intermediate portion of a respective one of said second and third fittings, providing mounts for fixedly securing said second and third fittings in fixed relation to the building, and wherein said support members define support bars which extend in spaced apart relation from exterior surfaces of respective ones of said second and third fittings.

20. A flexible duct system for connecting between an air handling unit and one or more building spaces for passing building air between the air handling unit and the one or more building spaces, the flexible duct system comprising:

a transition fitting mounted to a plenum connected directly to the air handling unit, said transition fitting having a transition fitting longitudinal axis, a first end facing in a first direction and mounted directly to the plenum, and a second end which is distally disposed from the plenum, said second end defining a second terminal end and having a second end profile which includes a tapered surface and a catch shoulder, wherein said tapered surface circumferentially extends around said transition fitting longitudinal axis and faces in a second direction which extends outward of said transition fitting with said tapered surface narrowing in the second direction, and said catch shoulder faces in a direction opposed to said second direction and is spaced apart from said second terminal end to define an abutment;

a first flexible duct having a first end portion fitting over said tapered surface and said catch shoulder of said second end of said transition fitting, and said first flexible duct further having a second end portion which is distally disposed from said first end portion;

a first band extending around said first end portion of said first flexible duct and engaging against said catch shoulder to fixedly secure said first end portion of said first flexible duct to said transition fitting;

a second fitting which is spaced apart from said transition fitting, said second fitting having a second fitting longitudinal axis and a forward end which defines a third terminal end, said forward end having a third end profile which includes a third tapered surface and a third catch shoulder, wherein said third tapered surface circumferentially extends around said second fitting longitudinal axis and faces in a third direction which extends outward of said second fitting with said third tapered surface narrowing in the third direction, and said third catch shoulder faces in a general direction opposed to said third direction and is spaced apart from said third terminal end to define a third abutment;

said second portion of said first flexible duct fitting over said third tapered surface and said third catch shoulder of said second fitting;

a second band extending around said second end portion of said first flexible duct and engaging against said third catch shoulder to fixedly secure said second end portion of said first flexible duct to said forward end of said second fitting; and wherein at least one of said third and fourth ends of said second fitting have multiple end profiles, each of said multiple end profiles disposed in alignment for tapering in an outward direction for being received in respectively smaller nominal sizes of flex ducting.

21. The flexible duct system according to claim 20, wherein said multiple end profiles are spaced apart with cut-lines disposed between adjacent ones of said multiple ends.

* * * * *